US006257333B1

(12) United States Patent
Mann et al.

(10) Patent No.: US 6,257,333 B1
(45) Date of Patent: Jul. 10, 2001

(54) REVERSE FLOW GAS SEPARATOR FOR PROGRESSING CAVITY SUBMERGIBLE PUMPING SYSTEMS

(75) Inventors: Jay S. Mann, Sherwood Park; Peter H. G. Straub, Leduc, both of (CA)

(73) Assignee: Camco International, Inc., Houston, TX (US)

( * ) Notice: Subject to any disclaimer, the term of this patent is extended or adjusted under 35 U.S.C. 154(b) by 0 days.

(21) Appl. No.: 09/453,974

(22) Filed: Dec. 2, 1999

(51) Int. Cl.[7] ..... E21B 43/38

(52) U.S. Cl. ..... 166/265; 166/66.4; 166/104; 166/105.5; 166/117.7

(58) Field of Search ..... 166/66.4, 67, 68.5, 166/69, 101, 104, 105.4, 105.5, 117.7, 265

(56) References Cited

U.S. PATENT DOCUMENTS

| | | | | |
|---|---|---|---|---|
| 33,736 | | 11/1861 | Elliot . | |
| 2,104,339 | | 1/1938 | Arutunoff | 183/2.7 |
| 2,721,620 | | 10/1955 | Geer et al. | 183/2.5 |
| 2,969,742 | | 1/1961 | Arutunoff | 183/2.5 |
| 3,175,501 | | 3/1965 | Carle | 103/102 |
| 3,291,057 | | 12/1966 | Carle | 103/113 |
| 3,336,732 | | 8/1967 | Carroll | 55/201 |
| 3,887,342 | * | 6/1975 | Bonnelle . | |
| 4,074,763 | | 2/1978 | Stevens | 166/325 |
| 4,088,459 | * | 5/1978 | Tuzson . | |
| 4,330,306 | * | 5/1982 | Salant . | |
| 4,481,020 | * | 11/1984 | Lee et al. . | |
| 4,676,308 | * | 6/1987 | Chow et al. . | |
| 5,173,022 | * | 12/1992 | Sango . | |
| 5,262,065 | * | 11/1993 | Hansen . | |
| 5,389,128 | | 2/1995 | Lopes | 96/207 |
| 5,417,088 | * | 5/1995 | Leblanc et al. . | |
| 5,525,146 | | 6/1996 | Straub | 96/214 |
| 5,653,286 | * | 8/1997 | McCoy et al. . | |
| 5,992,521 | * | 11/1999 | Bergren et al. . | |

FOREIGN PATENT DOCUMENTS

| | | | |
|---|---|---|---|
| 435716 | * | 7/1991 | (EP) . |
| 94025729 | * | 11/1994 | (WO) . |

* cited by examiner

*Primary Examiner*—Roger Schoeppel
(74) *Attorney, Agent, or Firm*—Fletcher Yoder & Van Someren

(57) ABSTRACT

A system for separating gas from a wellbore fluid as it is produced to the surface. The system includes a progressing cavity pump, a submergible electric motor and a fluid intake. The submergible electric motor is connected to the progressing cavity pump to drive the pump and draw wellbore fluid through the fluid intake. The fluid intake includes a hollow interior defined by a thick-walled section. Additionally, the fluid intake includes a plurality of fluid passageways extending through the thick-walled section. The passageways are oriented to create a reversal in fluid flow, and thus a release of gas, as the fluid is draw into the fluid intake.

16 Claims, 2 Drawing Sheets

REVERSE FLOW GAS SEPARATOR FOR PROGRESSING CAVITY SUBMERGIBLE PUMPING SYSTEMS

FIELD OF THE INVENTION

The present invention relates generally to a system and method for displacing fluids from a wellbore. More specifically, the present invention relates to a submergible pumping system utilizing a submergible electric motor, a progressing cavity pump, and a reverse flow gas separator to reduce the amount of gas pumped by the system.

BACKGROUND OF THE INVENTION

A variety of tools and other equipment are used in downhole, wellbore environments. For example, a progressing cavity pump may be utilized in producing petroleum and other useful fluids from production wells. When a progressing cavity pump system is used, production tubing is disposed within a wellbore to extend through the wellbore to the progressing cavity pump system disposed at a specific location within the well. The progressing cavity pump can be deployed or retrieved through the center of the production tubing, via a wireline or coiled tubing.

In operation, fluids contained in an underground formation enter the wellbore via perforations formed through a wellbore casing adjacent to a production formation. Fluids, such as petroleum, flow from the formation and collect in the wellbore. A progressing cavity pump moves the production fluids upwardly through the production tubing to a desired collection point.

A progressing cavity pump, consists of a single helical rotor which rotates inside a double internal helical stator. The rotor is typically made from a high strength steel while the stator is molded of an elastomeric material. When the rotor is placed within the stator, two chains of spiral cavities are formed. As the rotor turns, the cavities spiral up the length of the pump. Fluid within the cavities is carried along as the cavities progress up the length of the pump. Hence the name, progressing cavity pump.

A progressing cavity pumping system, typically includes a motor drivingly coupled to a progressing cavity pump. For oil field applications, the motor may be located on the surface and drivingly coupled from the surface down to a submergible progressing cavity pump in the wellbore. This is an example of a top-driven pumping system. Alternatively, the motor may be placed in the wellbore as part of an electrical submergible progressing cavity pumping system. Electric power is provided to a submergible electric motor drivingly coupled to a progressing cavity pump. The fluid displaced by the pump is communicated to the surface through production tubing. Spatial considerations among the pump, production tubing and motor encourage placement of the submergible electric motor below the progressing cavity pump. Such a system is an example of a bottom-driven pumping system.

A significant advantage of the progressing cavity pump is that the presence of gas in the fluid will not cause the progressing cavity pump to cavitate, as in other types of pumps. However, free gas in the fluid stream can occupy space in the cavities that could otherwise have been filled by desired liquids, such as oil. This reduces the pumps useful capacity and causes apparent pump inefficiency.

Rotary gas separators have been used to reduce the concentrations of gas in the fluid stream of submergible pumping systems utilizing other types of pumps, such as centrifugal pumps. Rotary gas separators use centrifugal force and differences in the specific gravities of fluids to separate a fluid into its constituent gases and liquids. Typically, the drive train of a submergible electric pumping system is coupled to the rotary gas separator. However, the drive train of a progressing cavity pump tends to produce oscillations and gyrations that propagate through the drive train during operation. Those oscillations and gyrations increase the stress on bearings supporting the drive train within the rotary gas separator and lead to a higher likelihood of bearing failure.

Additionally, the orientation of the motor, pump, and fluid intake in a bottom-driven system increases the complexity of using a rotary gas separator. Typically, in a bottom-driven system the system is oriented with the motor at the bottom of a tool string. The motor is coupled to the progressing cavity pump through a drive train. Fluid enters the system through a separate fluid intake that is located between the motor and the progressing cavity pump. Thus, the drive train coupling the motor to the progressing cavity pump must pass through the fluid intake to the progressing cavity pump. Consequently, the fluid intake and any other element between the motor and pump must provide structural support to the motor in order for the motor to provide torque to the pump. The structural member and torque requirements in a bottom-driven system, along with the oscillations and gyrations produced in a progressing cavity pumping system, must be factored into the design of any system incorporating a rotary gas separator into the tool string between the motor and pump.

Therefore, it would be advantageous to have a system that could reduce the quantity of gas pumped by a submergible electric progressing cavity pumping system without the use of a rotary gas separator.

SUMMARY OF THE INVENTION

The present invention features a submergible pumping system for displacing wellbore fluids. The system is comprised of a fluid intake and a submergible electric motor drivingly coupled to a progressing cavity pump. The fluid intake has a hollow interior defined by a thick-walled section. A plurality of fluid passageways extend through the thick-walled section and are oriented to create a reversal in fluid flow as fluid is drawn into the fluid intake.

According to another aspect of the invention, a pumping system for displacing wellbore fluids comprises a submergible electric motor, a progressing cavity pump operatively coupled to the submergible electric motor and disposed above the submergible electric motor when the system is oriented vertically, and a fluid intake disposed between the pump and motor. The fluid intake includes a body, a hollow interior within the body, and a sloped fluid passageway. The sloped fluid passageway extends through the body into communication with the hollow interior. When the system is oriented vertically the lowest point on an exterior end of a sloped fluid passageway is higher than the highest point on an interior end of the sloped fluid passageway.

According to another aspect of the present invention, a method of displacing wellbore fluids from a well is featured. The steps of the method are comprised of: drawing a wellbore fluid in a first direction along a fluid intake of a submergible pumping system, abruptly changing the flow of wellbore fluid to a second direction as the wellbore fluid enters the intake, maintaining a sufficient fluid flow rate, and maintaining a sufficient change from the first direction to the second direction to induce separation of a gas from the wellbore fluid.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
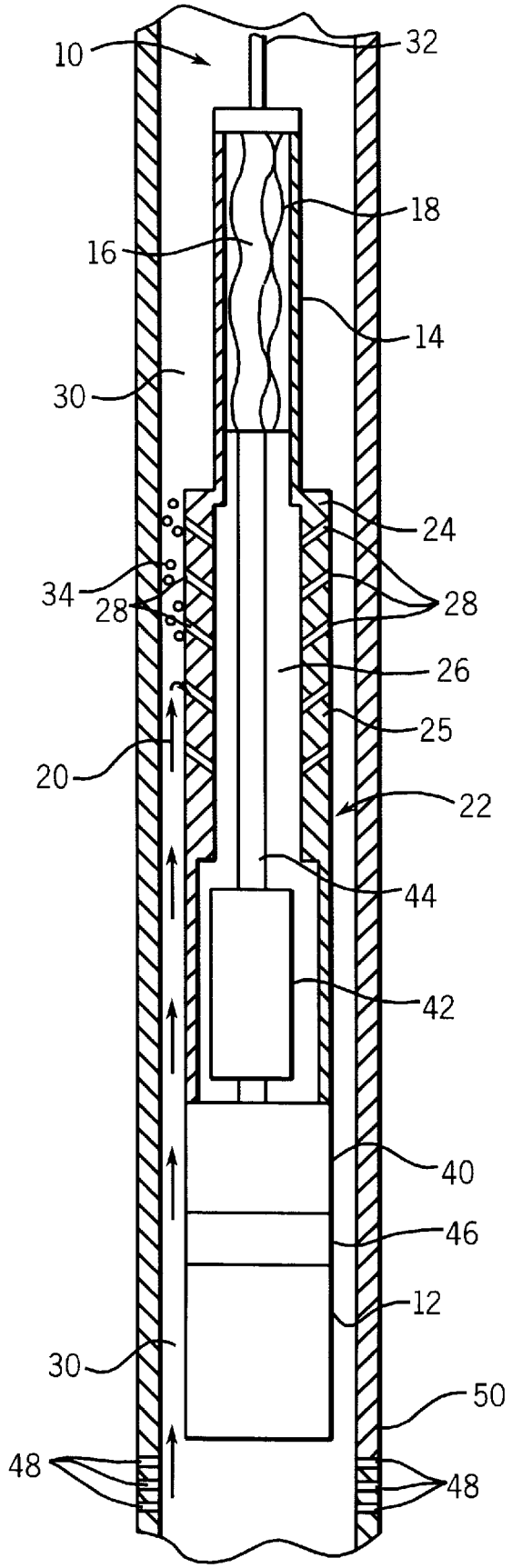
FIG. 1 is a front elevational view of a submergible pumping system, according to an embodiment of the present invention.

Referring generally to FIG. 1, a submergible pumping system 10 is shown in an exemplary downhole application, according to a preferred embodiment of the present invention.

In the particular example illustrated, a submergible pumping system 10 typically includes a submergible electric motor 12 drivingly coupled to a progressing cavity pump 14. The progressing cavity pump 14 includes a helical rotor 16 that rotates inside a double internal helical stator 18. The rotor 16 is made of high strength steel, and the stator 18 is made of an elastomeric material. Typically, two chains of lenticular, spiral cavities are formed when the rotor 16 is inserted into the stator. As the rotor 16 is rotated within the stator 18, the cavities spiral up the stator 18 carrying fluid along within the cavities.

A fluid 20 enters the pumping system 10 through a fluid intake 22 that directs the fluid 20 to the progressing cavity pump 14. The fluid intake 22 has a body 24 with a thick-wall section 25 defining a hollow interior 26. The thick-wall section 25 includes at least one and preferably a plurality of fluid passageways 28 that allow fluid 20 to be drawn from the wellbore 30, through the body 24, and into the hollow interior 26. The progressing cavity pump 14 intakes fluid from the hollow interior 26 and discharges the fluid to an external fluid receiving system through tubing 32.

The fluid passageways 28 are oriented in the body 24 so that as fluid 20 is drawn from the wellbore 30 it will undergo an abrupt change in direction in passing from the wellbore 30 into the hollow interior 26. The abrupt change in direction of the fluid 20 causes free gas 34 to break out of the fluid 20 and continue up the wellbore 30. The release of free gas 34 from the fluid 20 reduces the concentration of free gas 34 in the fluid 20 that is drawn into the progressing cavity pump 14, thus increasing the overall pumping efficiency of the pumping system 10.

The output speed of an electric motor is, typically, too great to use directly to drive a progressing cavity pump. Therefore, in the illustrated embodiment, a gearbox 40 is used to reduce the speed of the submergible electric motor 12. Additionally, a flexible drive 42 and shaft 44 are used to couple the gearbox 40 to the progressing cavity pump 14. The flexible drive 42 helps to compensate for the oscillating motion of the pump rotor 16. The flexible drive 42 and shaft 44 are housed within the hollow interior 26 of the fluid intake 22.

A motor protector 46 also is included between the submergible electric motor 12 and the gearbox 40. The submergible electric motor 12 and the gearbox 40 contain different fluids because of the specialized requirements of the submergible electric motor 12 and the gearbox 40. These fluids are separated by the motor protector 46 and allowed to equalize with the well pressure. Keeping the fluids separate prevents contamination in one component from spreading into the other component and causing further damage.

A flow of fluid from the wellbore 30 into the hollow interior 26 is produced by the operation of the progressing cavity pump 14. The progressing cavity pump 14 produces a low pressure region in the hollow interior 26 of the fluid intake. This creates a pressure differential between the fluid in the wellbore 30 and the fluid in the low pressure region of the hollow interior 26. The fluid in the wellbore 30 is drawn toward the low pressure region producing a flow of fluid 20 through the fluid passageways. Fluid from the surrounding geologic formation is drawn into the wellbore 30 through perforations 48 in the wellbore casing 50.

An important aspect of the present invention is the abrupt change in direction of fluid passing from the wellbore 30 into the hollow interior 26. The illustrated embodiment utilizes fluid passageways 28 with a downward angle through the body 24. A preferred method of operation is to position system 10 so the fluid passageways 28 are disposed above the perforations 48. In this manner, fluid 20 is forced to flow upward through the wellbore 30 from perforations 48 to the fluid passageways 28.

Because of the downward angle of the fluid passageways 28, fluid 20 is forced to change direction from a generally upward flow in wellbore 30 to a generally downward flow through fluid passageways 28. This effectively causes the fluid 20 to reverse its direction of flow. In other words, the direction of flow changes more than 90 degrees.

Figure 2:
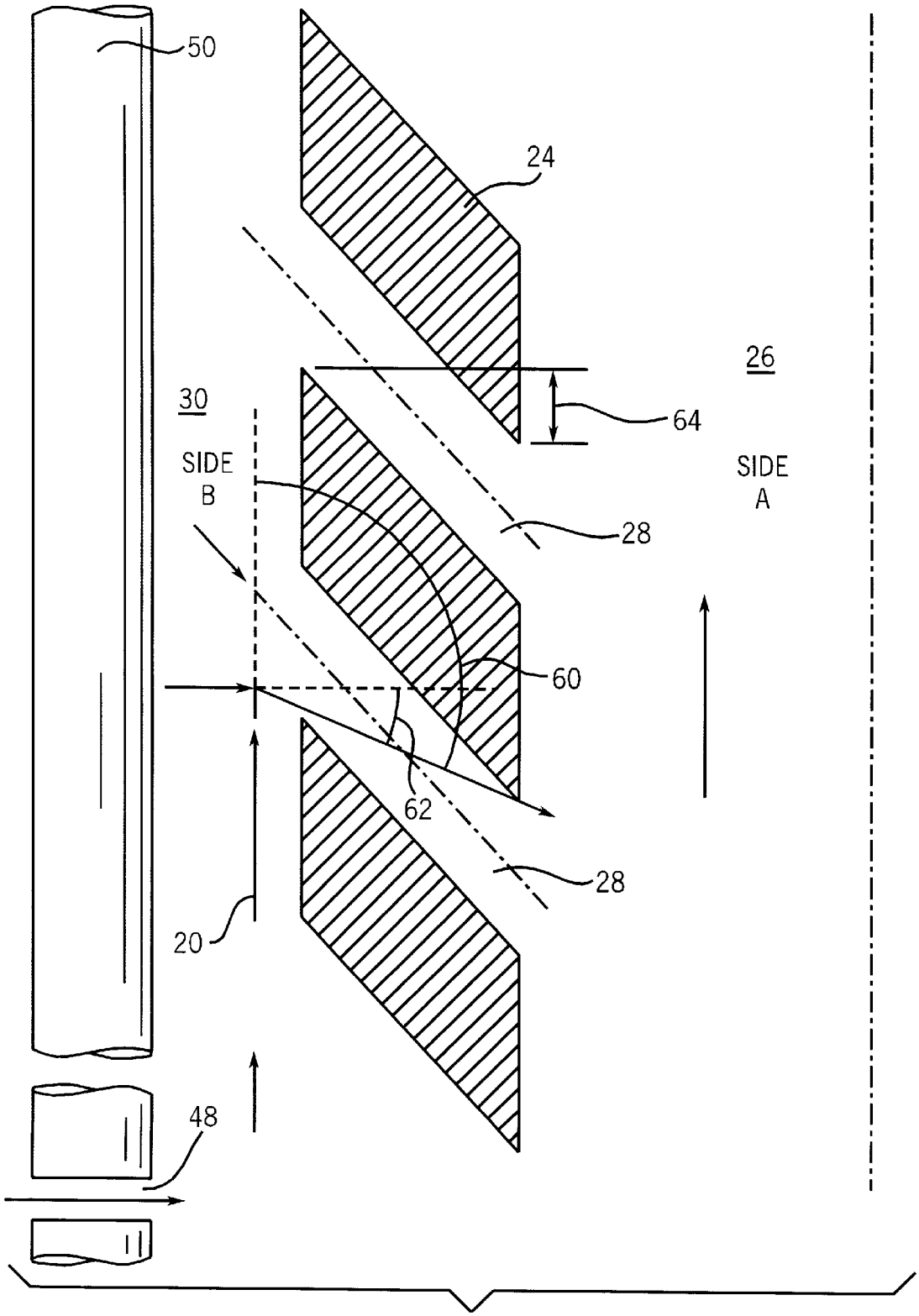
FIG. 2 is a detailed front elevational view of fluid flow in a wellbore and through a fluid passageway of a submergible pumping system, according to an embodiment of the present invention.

As illustrated in FIG. 2, reference number 60 represents the angle of deflection for a fluid flowing vertically through the wellbore 30. If the fluid passageways were instead oriented with the perforations in the wellbore roughly horizontal to the entrance of the fluid passageways 28 fluid would flow horizontally towards the fluid passageways 28. The change in direction of the fluid flow would not be as abrupt as if the flow were generally vertical. Reference number 62 represents the angle of deflection for fluid flowing horizontally through the wellbore 30. If the perforations 48 were positioned at just the right height above the fluid passageways there would be no change in the fluid direction at all when entering the fluid passageways.

There are many factors that can affect the degree to which the fluid passageways 28 change the direction of fluid flow. The angle, size, shape and length of the fluid passageways 28 all affect the direction of fluid flow through the fluid passageways 28. One method of changing the direction of fluid flow is to offset the entrance points and exit points of the fluid passageways 28. For example, in the illustrated embodiment, fluid passageways 28 are formed at an angle through body 24 such that the highest point on the hollow interior side (labeled Side A) of a fluid passageway 28 is lower than the lowest point on the exterior side (labeled Side B) of a fluid passageway 28. Reference number 64 represents the amount of offset between the highest point on the hollow interior side of a fluid passageway 28 and the lowest point on the wellbore side of a fluid passageway 28. Generally, increasing the amount of offset will increase the angle of deflection of the fluid. It should be noted that the length of each fluid passageway is not necessarily as long as the entire flow path through body 24. For example, some designs of body 24 may utilize flared regions or other formations at the interior side of certain fluid passageways 28. Such regions are not considered part of the fluid passageway designed to separate a gas from the fluid.

The length of the fluid passageways 28, often dictated by the thickness of the body 24, also can affect the degree to which the direction of the fluid flow is changed. Generally, with the downwardly angled fluid passageways of the illustrated embodiment, increasing the thickness of the body 24 produces a greater amount of offset 64. As described above, a greater amount of offset 64 generally means that a more abrupt change in direction of the fluid is achieved leading to greater separation of gas.

An additional aspect of the illustrated embodiment is that the diameter of the hollow interior 26 is preferably as small as practicable to allow the flexible drive 42 and shaft 44 to rotate and oscillate unobstructed. Although, the outer diameter of the fluid intake 22 is variable, it can be constrained somewhat by the typical use of the fluid intake as a coupling device for coupling the gearbox 40 to the submergible pump 14. Maintaining the diameter of the hollow interior 26 as small as possible allows a thicker body 24 to be used for a given outer diameter of the body 24.

Another operational consideration for submergible electric pumping system 10 is the provision of cooling for submergible electric motor 12. The pumping system 10 preferably is positioned in wellbore 30 so both fluid passageways 28 and submergible electric motor 12 are located above the perforations 48 in wellbore casing 50. Fluid is drawn upward by progressing cavity pump 14 past submergible electric motor 12. The upward flow of fluid effectively carries away heat, thereby, cooling the submergible electric motor 12.

It will be understood that the foregoing description is of preferred embodiments of this invention, and that the invention is not limited to the specific forms shown. For example, a variety of additional submergible pumping system components can be incorporated into the design and a variety of shapes, sizes, and number of fluid passageways can be utilized in the fluid intake. Additionally, the unique intake system may be used with other pumping systems and in a variety of other environments requiring separation of gas from liquid. These and other modifications may be made in the design and arrangement of the elements without departing from the scope of the invention as expressed in the appended claims.

What is claimed is:

1. A submergible pumping system for displacing wellbore fluids, comprising:

a progressing cavity pump;

a submergible electric motor, drivingly coupled to the progressing cavity pump; and a fluid intake, having;

a hollow interior defined by a thick-walled section; and a plurality of fluid passageways extending through the thick-walled section and oriented to create a reversal in fluid flow as fluid is drawn into the fluid intake.

2. The system as recited in claim 1, wherein at least one of the plurality of fluid passageways is sloped through the fluid intake such that when the fluid intake is oriented vertically, the lowest point on an exterior end of the at least one fluid passageway is higher than the highest point on an interior end of the at least one sloped fluid passageway.

3. The system as recited in claim 1, wherein the progressing cavity pump is disposed above the submergible electric motor.

4. The system as recited in claim 3, wherein the progressing cavity pump is comprised of a rotor drivingly coupled to a connecting rod.

5. The system as recited in claim 3, further comprising a flexible drive, wherein the flexible drive drivingly couples the submergible electric motor to the connecting rod of the progressing cavity pump.

6. The system as recited in claim 4, wherein the flexible drive and a portion of the connecting rod are disposed within the interior of the fluid intake.

7. The system as recited in claim 5, further comprising a gearbox, wherein the gearbox drivingly couples the submergible electric motor to the flexible drive.

8. The system as recited in claim 1, wherein each of the plurality of fluid passageways is sloped through the fluid intake such that when the fluid intake is oriented vertically, the lowest point on an exterior end of the at least one fluid passageway is higher than the highest point on an interior end of the at least one sloped fluid passageway.

9. The system as recited in claim 8, wherein the inner diameter of the hollow body is uniform along the length of the fluid intake.

10. The system as recited in claim 1, wherein the outer diameter of the hollow body is uniform along the length of the fluid intake.

11. A pumping system for displacing wellbore fluids, comprising:

a submergible electric motor;

a progressing cavity pump operatively coupled to the submergible electric motor and disposed above the submergible electric motor when the system is oriented vertically; and a fluid intake disposed between the pump and motor, the fluid intake having:

a body;

a hollow interior within the body; and a sloped fluid passageway extending through the body into communication with the hollow interior, wherein when the system is oriented vertically the lowest point on an exterior end of a sloped fluid passageway is higher than the highest point on an interior end of the sloped fluid passageway.

12. The system as recited in claim 11, wherein the sloped fluid passageway includes a plurality of sloped fluid passageways.

13. The system as recited in claim 12, further comprising a flexible drive, wherein the flexible drive drivingly couples the submergible electric motor to the progressing cavity pump, further comprising a flexible drive, wherein the flexible drive drivingly couples the submergible electric motor to the progressing cavity pump.

14. The system as recited in claim 13, further comprising a gearbox, wherein the gearbox drivingly couples the submergible electric motor to the flexible drive.

15. The system as recited in claim 13, wherein the flexible drive is disposed within the hollow interior of the fluid intake.

16. The system as recited in claim 15, wherein at least one of the sloped fluid passageways enters the hollow interior is smaller in diameter than the diameter of the hollow interior wherein the flexible drive is disposed.

* * * * *